US005660376A

United States Patent [19]

West

[11] Patent Number: 5,660,376

[45] Date of Patent: Aug. 26, 1997

[54] CAP AND MOUNTING FOR A FENCE SYSTEM

[76] Inventor: Ronald R. West, 545 E. 200 North, Provo, Utah 84606

[21] Appl. No.: 670,941

[22] Filed: Jun. 26, 1996

Related U.S. Application Data

[62] Division of Ser. No. 432,936, May 1, 1995, Pat. No. 5,556, 079.

[51] Int. Cl.[6] ..... E04H 17/14

[52] U.S. Cl. ..... 256/22; 256/1; 256/19

[58] Field of Search ..... 256/21, 22, 19, 256/1, 66, 65

[56] References Cited

U.S. PATENT DOCUMENTS

| | | | |
|---|---|---|---|
| 2,249,381 | 7/1941 | Gustafson | 256/22 X |
| 3,315,943 | 4/1967 | Van Den Broek | 256/22 |
| 3,822,053 | 7/1974 | Daily | 256/22 |
| 3,955,801 | 5/1976 | Soriero, Jr. | 256/65 |
| 3,960,367 | 6/1976 | Rogers | 256/21 |
| 4,602,765 | 7/1986 | Loper et al. | 256/19 |
| 4,722,514 | 2/1988 | Pettit | 256/66 X |
| 4,991,823 | 2/1991 | Stanish, Jr. | 256/65 X |
| 5,078,367 | 1/1992 | Simpson et al. | 256/19 X |
| 5,421,556 | 6/1995 | Dodge et al. | 256/1 |

FOREIGN PATENT DOCUMENTS

| | | | |
|---|---|---|---|
| 3440160 | 5/1986 | Germany | 256/9 |

*Primary Examiner*—Harry C. Kim
*Attorney, Agent, or Firm*—M. Reid Russell

[57] ABSTRACT

A cap and mounting for a fencing system that includes a number of straight plastic tubes that are cut appropriately into posts, cross members and pickets as the fence members and are for connection together to form a picket fence, with embodiments of cap arrangements for fitting over an open top end of each post and picket that includes a connectorless coupling for each cap for locking the cap onto each post and picket by urging a lower cap end into the post or picket, whereby ends of a lock bar are urged into the post or picket inner side walls, securing the cap thereon.

6 Claims, 4 Drawing Sheets

10
12
13
14
40
41
42a
42b
43
44a
45
45b
46b
47a
47
48a
47b
48b
4
24
25
23
11c
15
27
28
29a
22
21
20
26
29a
29
30
35
11b
11
2
37a
11b
35
37
36
23
15
25
19
24
21
16
20
13a
26
27
17
28
22
18
29a
29a
30
29
2

CAP AND MOUNTING FOR A FENCE SYSTEM

This application is a division of application Ser. No. 08/432,936, filed on May 1, 1995, U.S. Pat. No. 5,556,079.

BACKGROUND OF THE INVENTION

1. Field of the Invention

This invention relates to fencing systems and in particular to fences constructed by connecting pickets and posts, that are preferably formed from flat plastic tubes, to cross members that are preferably also flat plastic tubes, and including caps for capping which pickets and posts.

2. Prior Art

The present invention is in a fencing system, including picket and post caps and a mounting clip arrangement for securing hollow plastic fence posts and pickets onto cross members to form a picket fence. Where earlier picket fence systems have utilized pickets and even posts and cross members formed from plastic, the connection arrangements for Joining such components together have involved conventional fasteners, such as bolts with nuts turned thereover and screws. Such systems have not, within the knowledge of the inventor, included a fastener device that provides, after connection to a first member, and with a sliding of another member over the first member, for connection of and locking together of the two members. Which fastener device of the invention is mounted onto the first member to fit through a key hole formed in the other member to engage and bind against an inner surface of which other member. Further, within the knowledge of the inventor, no system has heretofore employed picket and post cap that includes a metal strip, that is preferably a section of a spring steel material and its mounting to the cap, as a connectorless coupling arrangement for mounting and locking the cap onto an open top end of a picket or post.

SUMMARY OF THE INVENTION

It is a principal object of the present invention in a fencing system with post and picket cap and mounting clips to provide an arrangement of pickets, cross members and posts that are joined and locked together with mounting clips of the invention into a permanent picket fence.

Another object of the present invention in a fencing system is to provide a system whose mounting clip components can be joined and locked together by an unskilled person utilizing only a screw driver type tool to assemble the picket fence.

Another object of the present invention in a fencing system is to provide a single mounting clip for connecting all the fence components of the invention that is secured to a fence member by a single screw only and provides for joining both the fence cross members to fence posts and for mounting pickets onto the parallel cross members that will both mount and lock the components together forming a permanent fence.

Still another object of the present invention in a fencing system is to provide a snap-on locking cap that is arranged for crowning each post and picket that can be installed without tools.

Still another object of the present invention in a fencing system is to provide an easily assembled picket fence where the components are preferably flat plastic tubes that are joined together, forming the fence, utilizing a single type of mounting clip and snap on caps only.

In accordance with the above objects, the present invention in a fencing system preferably includes posts, cross members and pickets that are all formed from plastic tubes. The cross members and pickets are essentially flat rectangular tubes, with the posts preferably formed from square tubes. The invention includes a single type of mounting clip for joining, respectively, at least a pair of cross members onto the posts. The pair of cross members are essentially parallel and extend at approximately right angles between posts that are secured to a ground stake, or the like, to extend therefrom. The cross members, in turn, also utilize individual mounting clips to secure individual pickets thereto, such that the pickets extend between the pair of spaced parallel cross members.

Each mounting clip includes a flat center section wherethrough a hole is formed to receive a conventional screw. A tab is formed in a first or top clip end as by bending it at spaced intervals thereacross, forming an upright wall at the bends between essentially parallel spaced apart sections. A tab end section is bent slightly upwardly away from the plane of the tab top section. The opposite sides of a second or bottom clip end slope outwardly, forming a broad end by first bending upwardly the tab broad end across a lower edge of the tab flat center section to elevate the tab broad end above the plane of the tab center section. Thereafter, the tab broad end is bent downwardly across its midsection to where a flat straight end edge of that tab broad end will essentially align with a bottom or undersurface of the tab flat center section.

The described mounting clip is preferably used to both secure the cross members to the posts and the pickets onto the cross members. To provide this coupling, an inverted keyhole is formed in a first member, either the cross member or picket, to be fitted over a mounting clip that has been secured to the surface of a second member, either the post or cross member. The mounting clip is preferably secured thereto as by turning a screw through the clip center section hole and into the surface of which second member. The mounting clip broad end is formed to fit into a keyhole large end opening and, as the first member is moved, the mounting clip slides up along a keyhole narrow slot. So arranged, the mounting clip broad end slides into the keyhole narrow slot, with a mounting clip straight end edge spanning that narrow slot. Thereby, the end sections of the mounting clip straight end edge travel into or bite into the member inner surface, alongside both sides of the keyhole narrow slot. Travel of the first member across the second member is finally blocked by the end of the keyhole narrow slot engaging and sliding under the mounting clip upturned tab end to the tab upturned wall. The mounting clip tab end is thereby elevated and pivots around the screw mounting, urging the clip broad end downwardly. The clip broad end flat straight edge is thereby urged into the first member inner surface, alongside the keyhole narrow slot. The straight edge thereby travels into or bites into the plastic surface, prohibiting movement of the first member out of engagement with the mounting clip, permanently mounting the first and second members together.

Each picket includes two spaced keyholes, each to mount onto one of a pair of mounting clips that are themselves individually secured in alignment onto surfaces of each of the parallel cross members. The cross members, at their ends, include the described keyholes that are for fitting onto mounting clips that have been secured to the surface of a post. Of course, more than two cross members, extending between upright posts mounted that extend upwardly from the ground, could be so employed to receive a number of spaced parallel pickets, as described, forming a picket fence.

With the posts, cross members and pickets connected together, as described, into a picket fence, the fence posts and pickets open ends can be closed over by a cap of the invention. Which cap preferably includes a top portion that can be a pyramid, rectangle or other shape, and preferably has a bottom pier arrangement to fit into the picket or post with a lip that is formed to fit across the post or picket open end. The pier arrangement may be a pair of spaced parallel walls, and is secured to the cap bottom to extend downwardly from the cap undersurface and fit into the post or picket and includes a flexing strap or bar and is secured across the pier arrangement. The flexing strap, preferably a flat narrow section of a spring steel material, or the like, is secured onto the post arrangement and has a greater length than the width of the post or picket opening whereacross it is fitted. Accordingly, as the cap is urged over the post or picket end, with the pier traveling into that post or picket opening, the strap ends will be bent upwardly. The cap pier arrangement is fully inserted into the post or picket, until a cap lower edge engages the post or picket top end. In that installation, the strap ends each engage and tend to travel slightly into the post or picket inner surface, biting therein so as to resist removal of the cap. The cap is thereby permanently mounted onto the post or picket end.

THE DRAWINGS

In the following drawings illustrate that which is presently regarded as the best mode for carrying out the invention:

Figure 1:
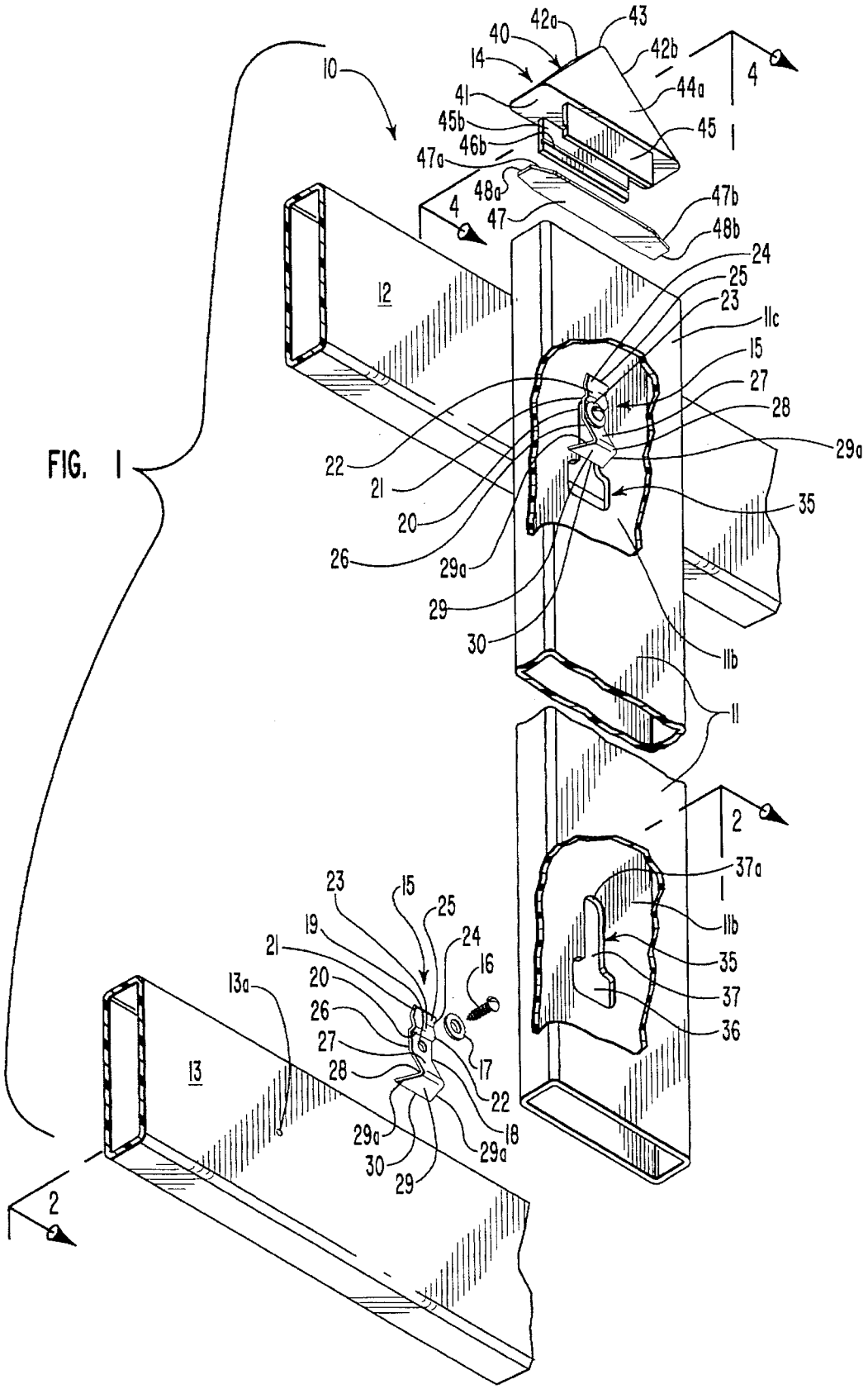
FIG. 1 is a frontal exploded perspective view of top and bottom sections of a picket, with open sections formed therein to exposed keyhole openings, with the picket shown being connected, utilizing mounting clips of the invention, onto cross members, and showing a cap of the invention aligned for fitting over the picket open top end.
Figure 2A:
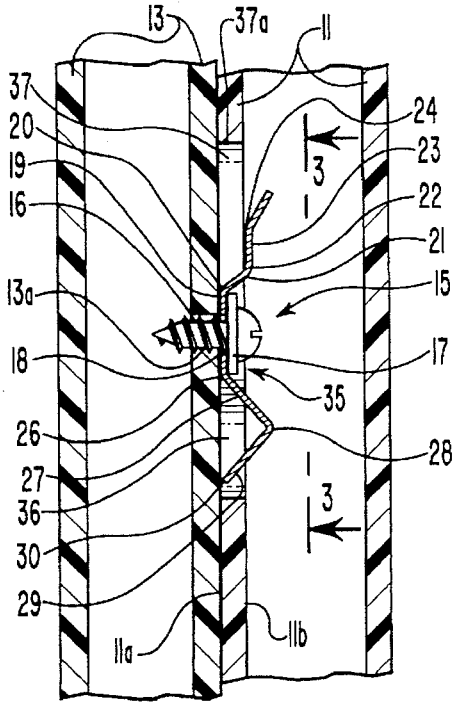
FIG. 2A is an enlarged sectional taken within the line 2—2 of FIG. 1 showing the mounting clip of the invention secured onto the cross member with the picket shown fitted thereon, and with the picket keyhole opening shown fitted over the mounting clip.
Figure 2B:
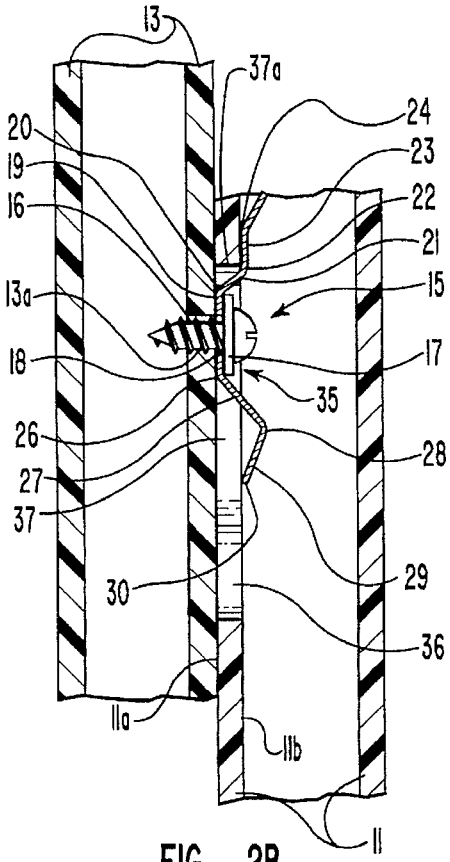
Figure 3:
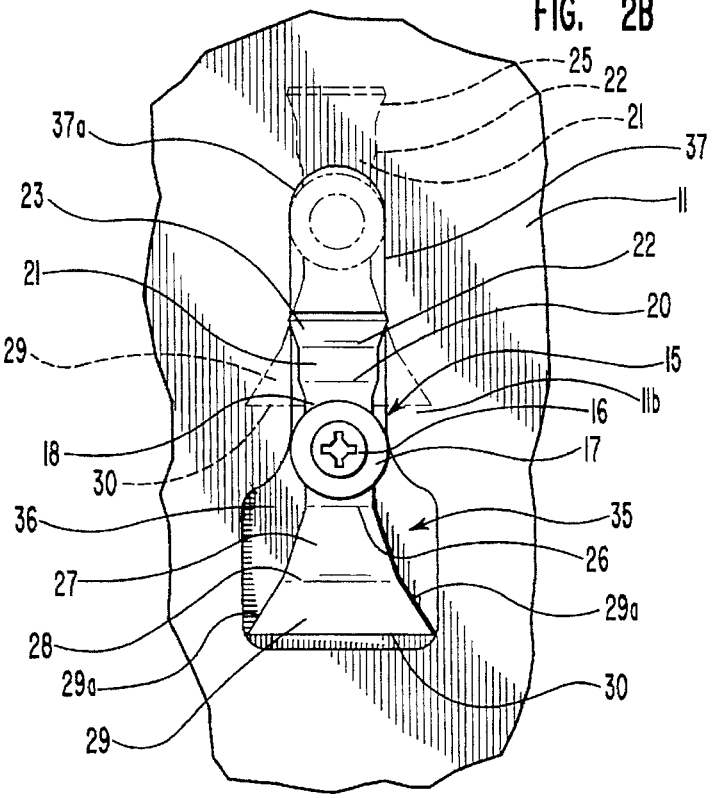
Figure 5:
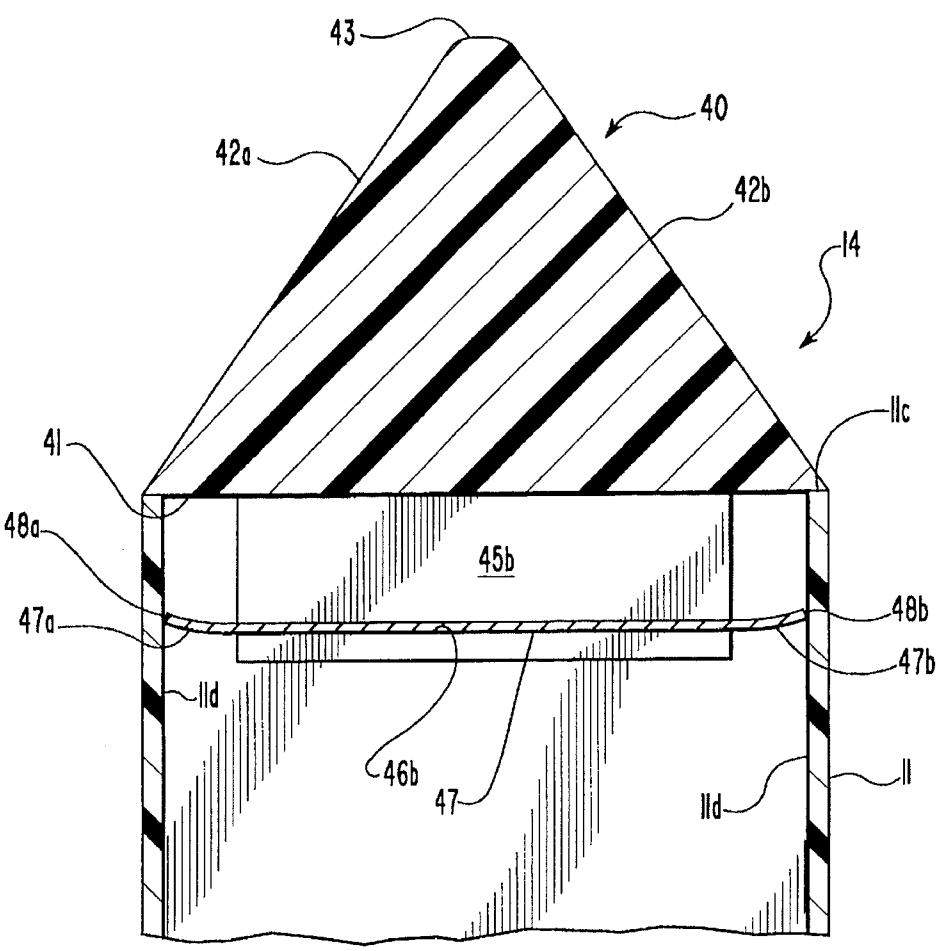
Figure 4:
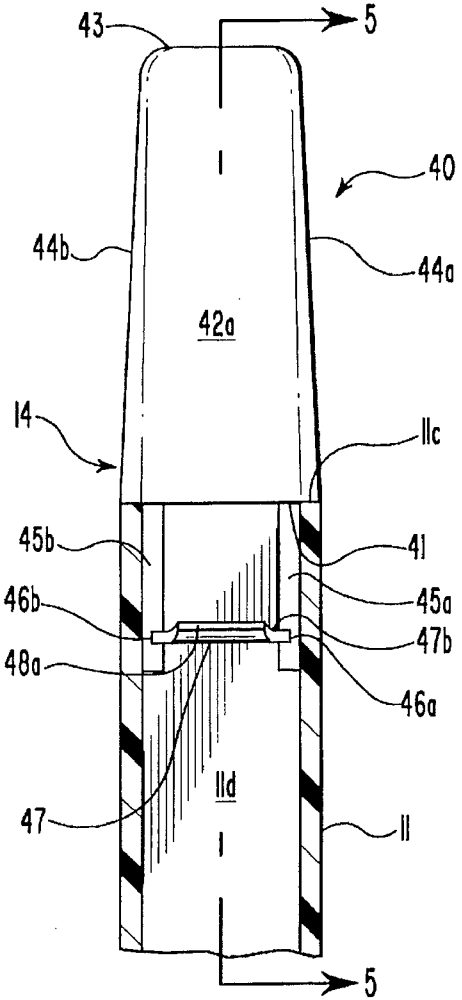
Figure 7:
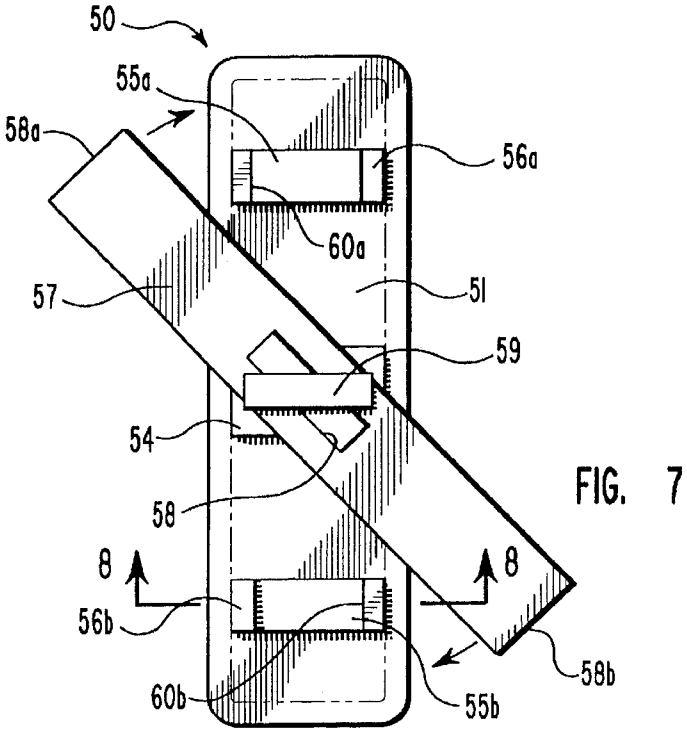
Figure 8:
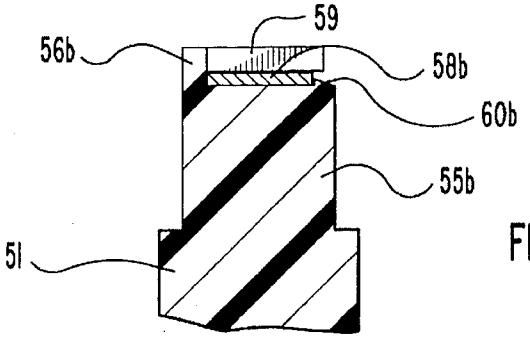
Figure 6:
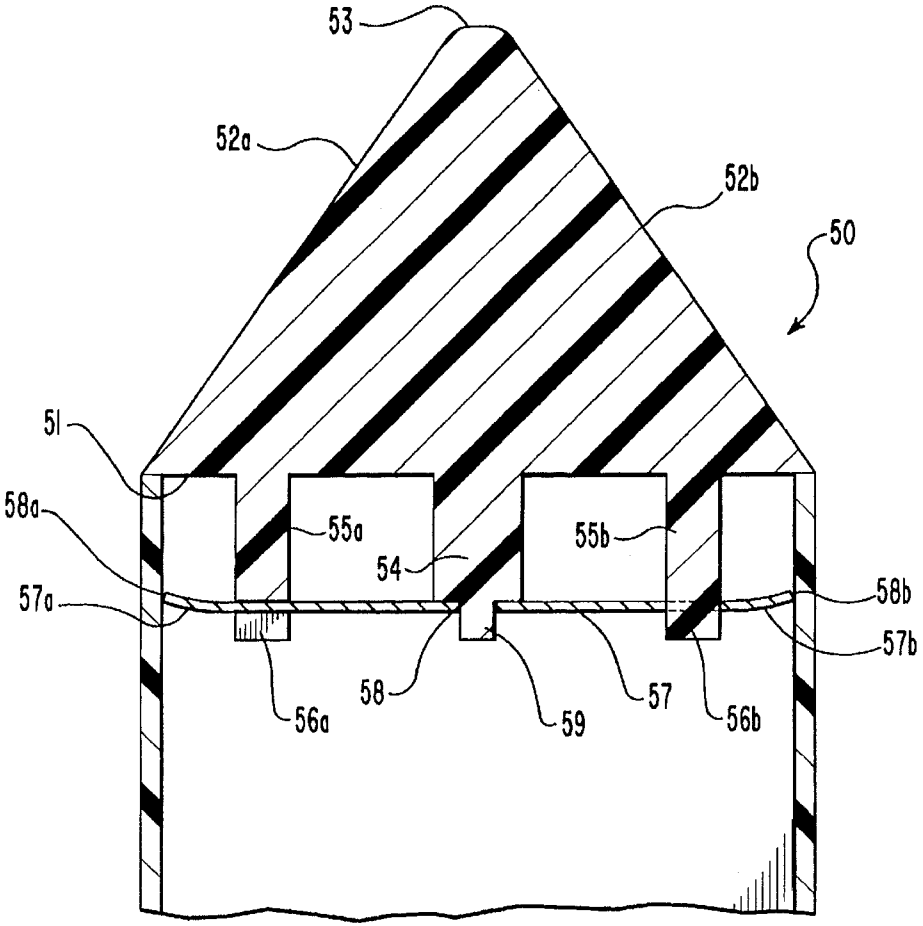

FIG. 2B is a view like FIG. 2A only showing the picket as having been moved downwardly across the cross member, moving the mounting clip along the keyhole narrow section to where a top end thereof engages the end of the keyhole narrow section, and with a mounting clip broad end thereof urged downwardly to where a broad head end edge spans the keyhole narrow section and is urged into the material of picket interior surface, locking the picket onto the cross member;

FIG. 3 is a view of the mounting clip fitted through the picket keyhole of FIG. 2, shown in solid lines, with the mounting clip, shown in broken lines, as having been moved along the keyhole narrow section to the attitude shown in FIG. 2B;

FIG. 4 is a sectional view taken along the line 4—4 of FIG. 1, showing a side elevation sectional view of a first embodiment of the cap fitted into the picket open top end;

FIG. 5 is a front elevation sectional view taken along the line 5—5 of FIG. 4 showing a pair of spaced parallel walls as a pier arrangement whereto a strap formed from a section of a thin flexible spring steel material is maintained fitted into opposing slots, which Strap is seated in the picket top, with strap ends shown as having bent upwardly with travel of the cap into the picket that engage the inner surface of the picket sides, locking the cap onto the picket end;

FIG. 6 is a view like that of FIG. 4 showing a second cap embodiment that includes, as a pier arrangement, a center pier and side piers that are parallel with a strap like that of the strap of FIGS. 5 and 5, and is releasably secured at a T-post that extends from the center pier, and is braced against movement by steps formed in top ends of the side piers;

FIG. 7 is a bottom plan view of the bottom of the cap of FIG. 6 showing a center slot of the strap fitted over the T-post, shown in broken lines, and pivoted into a seating engagement over the side piers, shown in solid lines; and FIG. 8 is a longitudinal sectional view taken along the line 8—8 of FIG. 7 showing the profile view of the pier whereto a trap is mounted.

DETAILED DESCRIPTION

FIG. 1 shows a preferred embodiment of a section of a fencing system with mounting clips and caps 10 of the invention, hereinafter referred to as fencing system 10. The fencing system 10 is represent by a single picket 11 positioned for attachment to each of a pair of spaced parallel top and bottom cross members 12 and 13, respectively, the picket 11 extending thereacross. A top cap 14, that may be cap 40 shown in FIGS. 1, 4 and 5 and cap 50 as shown in FIGS. 6, 7, and 8 is shown aligned for installation onto an open top end 11c of picket 11. The respective picket 11 and cross members 12 and 13, as well as cap 14, are shown as being manufactured from a plastic material, and a plastic material known as polyvinyl chloride (PVC). Which plastic may be colored, as required, is weather and sun resistant, and will retain some resiliency even after aging. The connection of pickets 11 onto the cross members 12 and 13 is shown provided utilizing mounting clips 15, as described later herein.

While a single picket 11 and two cross members 12 and 13 are shown and described herein as the fencing system 10, it should be understood that any length of fence can be constructed from fencing system 10 to include posts that are arranged for mounting to extend vertically upwardly from the ground, whereto ends of at least a pair of cross members 12 and 13 are connected. Which posts also preferably utilize mounting clips 15 that are used to join the cross member ends onto thereto. So arranged, the cross members will extend between spaced posts, not shown, and are parallel to one another. Of course, a number of spaced apart pickets 11 are secured, as described below, utilizing mounting clips 15 such that the pickets extend between the cross members 12 and 13. Which posts are preferably essentially parallel to one another, forming a picket fence, with caps 14 arranged to fit onto a top end 11c of each picket 11, and with a cap like cap 14 arranged to be fitted onto each post top end.

Shown in FIGS. 1, 2A and 2B, pickets 11 and cross members 12 and 13, are preferably formed from a preferred plastic material, such as polyvinyl chloride (PVC), as flat tubes each having essentially a rectangular cross section, as are the posts, not shown, that are preferably hollow tubes and preferably have a square cross section. For Joining the cross member ends onto the posts, the posts receive the mounting clips 15 connected thereto. Keyhole slots, as described below, are formed in an inner face of ends of each of the cross members, opposing the post surface, that are used for coupling each cross member end onto the post, utilizing the procedure described below for coupling individual pickets 11 onto the cross members 12 and 13.

For mounting the individual pickets 11, in spaced parallel arrangement, where the pickets extend between and across the cross members 12 and 13, as shown in FIG. 1, forming the picket fence, a mounting clip 15 is provided for each point of connection. Each mounting clip 15 is for installation onto a surface of a cross member 12 or 13, or post, not shown. Connection is provided by turning a screw 16, by self drilling, riveting, or the like, through a mounting clip 15 flat center section 18 hole 19, that is turned into the cross member, and may involve forming a hole like hole 13*a*, as shown in FIG. 1. Such hole 13*a*, of course, is formed to have a lesser diameter than the screw 16 threads and is provided for mounting the mounting clip at a predetermined optimum location. The screw 16 is approximately centered in the cross member though it could, of course, be formed closer to a top or bottom edge thereof, as desired, depending upon the length of a keyhole slot 35 formed in one picket face. Such hole 13*a* formation may also be influenced by whether it is desired to leave a wide bottom end of which keyhole slot exposed so as to provide access to the mounting clip after the picket and cross members are joined together, or whether it is desired to close over the keyhole wide bottom end.

Shown in FIG. 1, the screw 16 is preferably a conventional metal screw that is fitted through the mounting clip 15 and may be turned into hole 13*a*. To receive the screw 16, the mounting clip, that is preferably formed by appropriately cutting and bending a single section of a metal material, includes the flat center section 18 wherethrough hole 19 is formed that is to receive the screw 16 fitted therethrough. Each mounting clip 15 is preferably a single unit that includes the flat center section 18 and is bent upwardly across a top edge 20 of which flat center section into an upwardly angled flat wall 21. The flat center section is then bent thereacross at 22, at a top edge of the wall 21, forming a tab end section 23. The tab end section 23 is essentially parallel to the flat center section 18, and, at a midsection, is bent upwardly at 24 into a tab 25. In practice, as set out below, with the mounting clip 15 fitted into the keyhole slot 35, and the keyhole slot is pulled over the mounting clip, the tab 25 and tab end section 23 will travel alongside the keyhole slot to where the flat wall 21 engages a rectangular end section 37 of that keyhole slot 35, as shown best in FIG. 2B.

A broad bottom end portion of the mounting clip 15, that has outwardly sloping sides 29*a*, is formed by bending that bottom end portion upwardly across a lower end 26 of the flat center section 18, forming a flat section 27. A wide end section 29 is formed at a downward bend 28 formed across the lower end of the flat section 27. Which wide end section 29 terminates in a straight edge 30 thereacross that includes a right angle edge that is to rest on and travel or bite into a soft plastic surface, as described below. The outwardly sloping sides 29*a* of the wide end section 29 have a width at its straight edge 30 that is greater than the distance across the keyhole slot 35, upper section 37. So arranged, the straight edge 30 will extend across the keyhole slot 35 with its right angle edge resting on the fencing member plastic surfaces that is adjacent to which keyhole slot upper section, as shown in broken lines in FIG. 3. The contact of the end portions of the mounting clip straight edge 30 provide for locking, engaging the plastic surface of the picket 11 for maintaining it secured on the cross members 12 and 13, as set out hereinbelow.

As set out above, each mounting clip 15 is secured, as by screw 16, onto a post or cross member 12 or 13, with a keyhole slot 35 formed in the face or surface of an opposing cross member or picket 11 to be secured thereto. As shown in FIGS. 1, 2A and 2B, the picket 11 face 11*a* preferably includes a pair of spaced keyhole slots 35 that are formed therethrough. Each keyhole slot to include a bottom section 36 and a top rectangular shaped upper section 37. The diameter or width of the keyhole bottom section 36 is greater that the width of the mounting clip broad end 29, across its straight edge 30, and allows for passage of the mounting clip 15 therethrough, as shown best in FIGS. 2A and 3. The keyhole slot upper section 37 has a width that is greater than the mounting clip 15 from the flat center section 27 upwardly to the tab 25. So arranged, with the keyhole bottom section 36 aligned to fit over the mounting clip broad end 29, the keyhole upper section 37 will align with the top portion of the mounting clip. The keyhole slot 35 is thereafter allowed to pass over the mounting clip 15 as the picket 11 containing the keyhole slot is moved across the respective cross members 12 and 13 surfaces, as shown best in FIG. 2A. Thereafter, moving, as by pulling, the picket 11 downwardly relative to the cross members 12 and 13, the keyhole slot 35 will travel along the mounting clip 15. Which travel is stopped where, as shown in FIG. 2B and in broken lines in FIG. 3, the mounting clip tab 25 and tab end section 23 will have slid over a top end 37*a* of the keyhole upper section 37, and the mounting clip 15 flat section 21 will have engaged the keyhole upper section top end 37*a*. In which keyhole slot 35 travel, the mounting clip broad end 29 travels into the keyhole upper section 37, such that the broad end straight edge 30 straddles the keyhole upper section 37, and with end portions of that straight edge 30 extending beyond the keyhole upper section sides. The right angle edges of which straight edge 30 thereby engage sections of a picket inner surface 11*b*, alongside the picket slot upper section 37. So arranged, as the keyhole upper section 37 slides under the mounting clip tab 25 and tab end section 23, the top or upper mounting clip end is elevated, thereby pivoting the mounting clamp around its screw 16 coupling and urging the mounting clip broad end 29 downwardly to where the right angle end portions of the straight edge 30 travel into or bite into the surface of the plastic picket inner surface 11*b*, as shown in FIG. 2B, prohibiting picket upward travel, locking the picket onto the cross members.

Preferably, for assembling a picket fence, the cross members 12 and 13 are each secured to posts, not shown, utilizing mounting clips 15, as described above for the installation of pickets 11 onto the cross members 12 and 13. To complete which picket fence assembly, caps 14 are preferably secured across the picket and post open top ends. A first embodiment of a cap 40, as cap 14, is shown in FIGS. 1, 4 and 5, configured for fitting over a picket 11 top end. It should, however, be understood, that the cap 40 cross section dimensions can be altered to function as post cap, within the scope of this disclosure.

As shown, the cap 14 preferably has a narrow pyramid shaped crown with a flat bottom surface 41, and sides 42*a* and 42*b* that slope inwardly into an apex 43, and includes forward and rear faces 44*a* and 44*b*, as shown best in FIG. 4. To provide for securing the cap 40 onto the picket 11 open top end 11*c* parallel narrow rectangular walls 45*a* and 45*b* are secured to the crown flat bottom surface 41, extending parallel therefrom, that each have an opposing surface wherein straight slots 46*a* and 46*b* are formed. The slots 46*a* and 46*b* are to receive opposing edges of a thin flat strap 47 that is preferably formed from a section of a spring steel material. Which strap, shown in FIGS. 1, 4 and 5, includes end edges 47*a* and 47*b* that terminate in a flat edge 48*a* and 48*b* extending therebetween.

In practice, shown in FIGS. 1, 4, through 8, the caps 40 and 50 align with the surfaces of the pickets and posts and are individually mounted therein by fitting the spring steel straps 47 or 57, into the picket 11 open top end 11*c*, and post top end, and urged therein such that the strap 47 and 57 ends will flex the picket or post interior walls, as shown in FIGS. 4 and 5. Thereby, the strap ends 47 or 57 will slide along opposing picket inner side walls 11*d*, to where the cap is fully seated on top of the picket 11 or post. Whereat, the strap flat edges are urged into to bite into the picket inner side walls 11*d*, or post inner side wall opposing removal of the cap off from the picket end 11*c* or end of a post.

Alternatively, FIGS. 6 and 7 show a second embodiment of a cap 50 that also preferably includes a flat bottom surface 51, and sides 52*a* and 52*b* that slope inwardly to an apex 53 and include forward and rear faces. Unlike cap 40, cap 50 includes spaced apart parallel piers, identified as center pier 54, and spaced apart side piers 55*a* and 55*b*. The center pier includes a T-post 59 extending upwardly therefrom to receive a center longitudinal elongate slot 58 formed in the center of a strap 57, that is like the strap 47 described earlier herein, and is also for mounting across the tops of piers 54 and 55*a* and 55*b* to provide for locking the cap 50 onto a fence picket 11 or post, as described hereinabove with respect to the functioning of cap 40.

For mounting the strap 57 onto piers 54 and 55*a* and 55*b* as shown in FIG. 7 and in the sectional view of FIG. 8, the straps 57 center longitudinal elongate slot 58 is fitted onto the T-post 59, shown in broken lines, and is pivoted therearound to the altitude shown in solid lines. In which pivoting, the strap opposite edges each travel up a slightly sloping track 60*a* and 60*b*, respectively, that is stepped downwardly into a flat surface, with the strap 57 edges fitting under shelves 56*a* and 56*b*, respectively, seating to the individual side piers 55*a* and 55*b*, thereafter functioning like strap 47, as described above.

While preferred embodiments of my invention in a fencing system including a counting clip and different cap embodiments have been shown and described herein for forming a plastic picket fence, it should be understood that the present disclosure is made by way of example only and the invention is suitable for uses other than those described such as picture frames, shelving, or like hollow items, without departing from the subject matter coming within the scope of the following claims, and a reasonable equivalency thereof, which claims I regard as my invention.

I claim:

1. A fencing system comprising:

a plurality of vertical first fence members and horizontal support second fence members, said first and second fence members being formed from sections of plastic tubes with means for connecting and locking each of the first fence members onto said horizontal support second fence members;

a cap means for fitting onto an open top end of each of said vertical first fence members; and means for locking said cap means onto said open top end of said first fence member, said locking means including a strap means that is a flat thin rectangular section of a stiff material that has a greater length than the distance between interior walls of said first fence member and a pier means that is secured to extend downwardly from a flat bottom surface of said cap means, said pier means including a straight longitudinal slot means arranged along at least one side surface of said pier means for retaining said strap means fitted therein such that said strap means extends across said pier means, wherein said pier means is arranged to fit into said open top end of said first fence member where opposite ends of said strap means engage opposing interior wall surfaces of said first fence members when said cap means is fitted thereon.

2. A fencing system as recited in claim 1, wherein the cap means includes a top portion having a decorative top shape that is formed by straight inwardly sloping sides that terminate in an apex.

3. A fencing system as recited in claim 1, wherein the section of the stiff material is a thin section of a spring steel material.

4. A fencing system as recited in claim 1, wherein the pier means includes a pair of parallel plates that extend at right angles from the flat bottom surface of the cap means and have said slot means in the form of opposing parallel slots formed on the side surfaces of said parallel plates for receiving said strap means slid therein.

5. A fencing system as recited in claim 1, wherein the pier means includes a center pier fitted between two parallel side piers that extend at right angles from the flat bottom surface of the cap means, said center pier includes a T-shaped post formed to receive and fit through an opening formed in the strap means and each of said side piers includes said slot means and means on a surface thereof for receiving and maintaining a portion of said strap means fitted thereto.

6. A fencing system as recited in claim 5, wherein the means on the surface for receiving and maintaining said strap means portion is a sloping section that is stepped downwardly onto a flat section formed on said surface of said side pier and further including a side edge section that extends downwardly from an inner edge of said side pier flat section to receive an edge of said strap means fitted thereunder.

* * * * *